United States Patent [19]

Pech

[11] 4,063,521

[45] Dec. 20, 1977

[54] INCINERATOR HAVING GAS FLOW CONTROLLING SEPARATOR

[75] Inventor: Jan J. Pech, Bartlesville, Okla.

[73] Assignee: Econo-Therm Energy Systems Corporation, Minnetonka, Minn.

[21] Appl. No.: 716,070

[22] Filed: Aug. 19, 1976

[51] Int. Cl.[2] ..... F23G 5/00; F23J 15/00

[52] U.S. Cl. ..... 110/8 A; 110/119

[58] Field of Search ..... 110/8 A, 8 C, 119; 23/277 C

[56] References Cited

U.S. PATENT DOCUMENTS

| | | | |
|---|---|---|---|
| 3,218,996 | 11/1965 | Wernheim | 110/8 A |
| 3,610,179 | 10/1971 | Shaw, Jr. et al. | 110/8 A |
| 3,651,771 | 3/1972 | Eberle | 110/8 A |
| 3,808,619 | 5/1974 | Vanderveer | 110/8 C |
| 3,951,082 | 4/1976 | Leggett et al. | 110/8 A |

*Primary Examiner*—Kenneth W. Sprague

*Attorney, Agent, or Firm*—Schmidt, Johnson, Hovey & Williams

[57] ABSTRACT

An improved, essentially pollution-free incinerator for waste materials is provided which includes vertically stacked, separately fired primary and secondary combustion chambers and central, cooperating, apertured partition and baffle structure serving to assure complete burning of the waste materials and removal of particulate solids prior to discharge thereof to the atmosphere. In preferred forms, the central, chamber-defining partition includes a plurality of circumferentially spaced, peripheral apertures, while the baffle structure is in the form of an annular, peripheral shoulder formed on the inner wall surface of the secondary chamber above the partition apertures. The primary chamber also includes a waste material inlet and a burner system for igniting the waste materials, while the secondary chamber has tangentially disposed air and fuel inlets for creating a whirling flow pattern to assure essentially complete high temperature burning of the waste materials.

8 Claims, 3 Drawing Figures

Fig. 2.
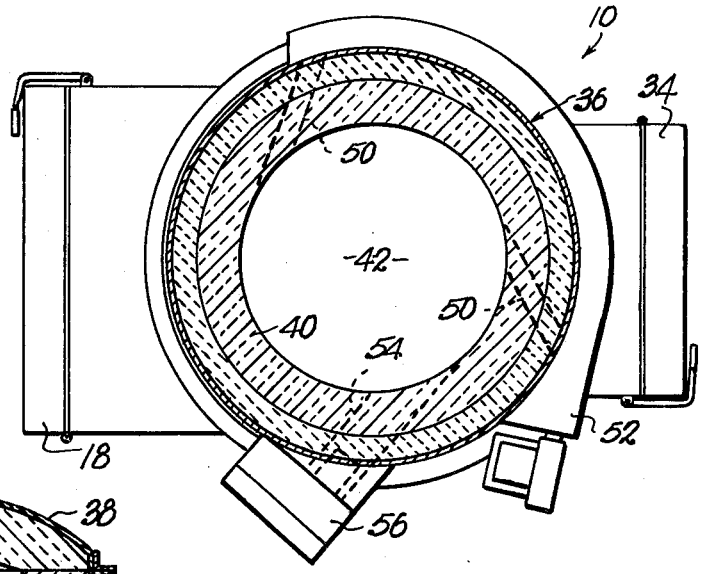
Fig. 1.
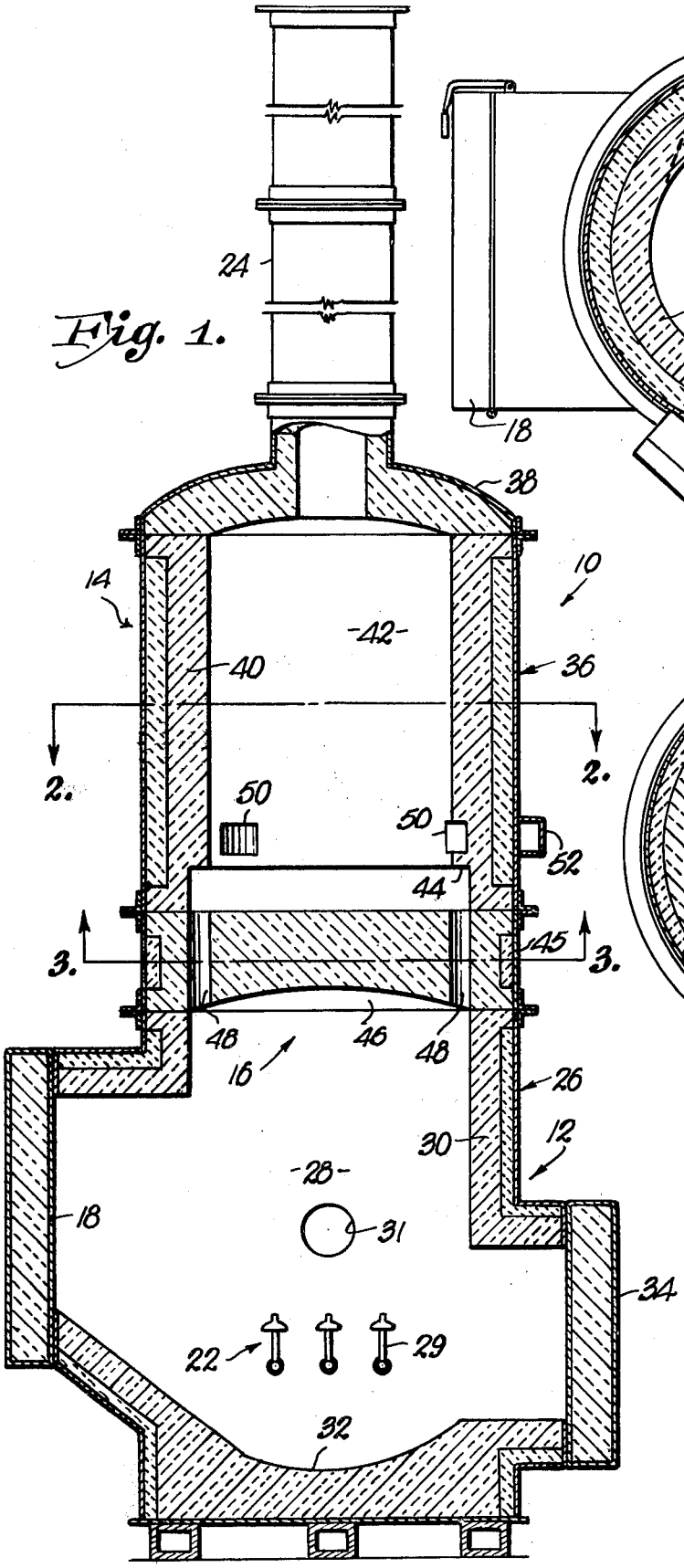
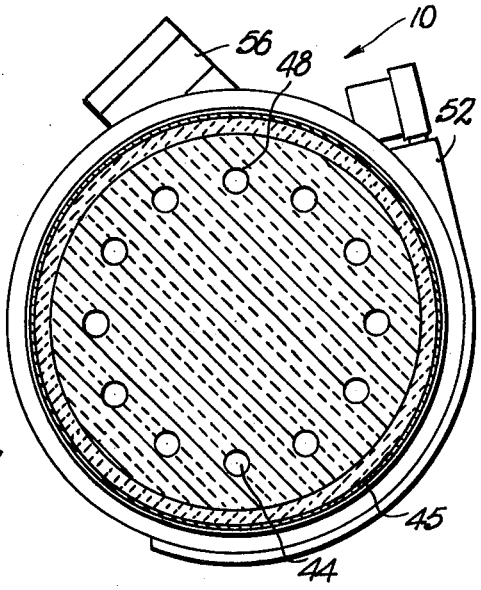
Fig. 3.

INCINERATOR HAVING GAS FLOW CONTROLLING SEPARATOR

This invention relates to an improved, dual chamber incinerator for waste materials which includes specialized structure for assuring complete burning of the materials without creating a pollution problem in the form of excessive particulate matter discharged to the atmosphere. More particularly, it is concerned with such an incinerator which includes a peripherally apertured, central, chamber-defining partition and an adjacent overlying baffle which cooperatively serve to deflect rising currents of combustion gases through the incinerator to thereby remove any entrained particulate material therein and ensure complete burning thereof.

A wide variety of incinerators have been proposed in the past for burning waste materials such as household and industrial refuse. Although many of these prior incinerators have achieved a certain degree of commercial success, a number of problems remain. First of all, recently promulgated pollution regulations have severely limited the amount of particulate matter that can be discharged to the atmosphere from incinerators, and accordingly a significant amount of research has been undertaken to improve the emissions performance of incinerators.

In this connection, it is also important that large incinerators, and especially those used for burning industrial refuse, be constructed for assuring essentially complete burning of the combustible fraction of the refuse. As can be appreciated, an inefficient incinerator presents problems not only in terms of particulate emissions, but also because they must be frequently cleaned to remove ash and the like, and this in itself can present a serious waste disposal problem.

It has been known in the past to provide waste incinerators with adjacent primary and secondary combustion chambers. This arrangement facilitates more complete burning of the waste materials by permitting the respective combustion chambers to operate at different temperature levels. In many instances the secondary combustion chamber is provided with positive pressure air inlets or tuyeres so that a whirling or cyclone pattern of air can be established within the combustion chamber since this is known to further enhance the efficiency of the incinerator. A number of prior patents disclose incinerators embodying such known concepts, see for example U.S. Pat. Nos. 1,267,646; 1,528,816; 1,886,760; 2,642,826; 2,754,779; 2,850,991; and 2,771,533.

It is therefore the most important object of the present invention to provide an incinerator especially adapted for efficiently burning industrial refuse and which is operable to essentially completely burn the combustible fraction of such waste materials while at the same time minimizing or completely eliminating the emission of objectionable particulate matter which normally results from waste combustion.

Another object of the invention is to provide an incinerator for industrial refuse which includes adjacent primary and secondary combustion chambers having an apertured partition therebetween, along with baffle structure situated within the secondary chamber adjacent the partition apertures; during operation of the incinerator, flow of combustion bases and products from the primary to the secondary chamber is deflected and slowed by virtue of the passage thereof through the apertures and around the baffle structure, so that any particulate matter entrained within such gases is removed and the combustible materials in the latter are completely burned.

A still further object of the invention is to provide an incinerator of the type described with vertically stacked, primary and secondary combustion chambers separated by a cylindrical partition having a plurality of circumferentially spaced, axial, peripheral apertures, with an overlying, annular shoulder formed in the inner wall of the uppermost secondary chamber serving as baffle structure directly above the partition apertures; the baffle structure and apertures are cooperatively configured and arranged for removing at least a portion of any solid sentrained within combustion gases passing from the primary chamber to the secondary chamber so that the discharge from the latter is essentially free of objectionable pollutants.

In the drawings:

FIG. 1 is a view in partial vertical section of an incinerator in accordance with the invention;

FIG. 2 is a sectional view taken along line 2—2 of FIG. 1 and illustrating the tangential air and fuel inlet structure provided with the uppermost, tubular secondary combustion chamber; and FIG. 3 is a sectional view taken along line 3—3 of FIG. 1 and further illustrating the configuration of the peripherally apertured central partition between the primary and secondary combustion chambers.

An incinerator 10 is illustrated in FIG. 1 and broadly includes a lowermost primary combustion chamber 12, a superposed tubular secondary combustion chamber 14, and a peripherally apertured, generally cylindrical partition 16 situated between and serving to partially define the respective chambers 12 and 14. In the usual fashion, primary chamber 12 includes a waste material inlet door 18, and a burner assembly 22 for igniting waste materials initially fed to the chamber 12. Secondary chamber 14 includes a centrally disposed, tubular discharge stack 24 serving to discharge gases produced within incinerator 10 to the atmosphere.

In more detail, primary chamber 12 includes an outermost metallic shell 26, which is configured to present a hollow burning area or chamber 28 and an uppermost gas outlet end which is circular in cross-section. Burner assembly 22 includes a plurality of burner elements 29, and in addition may include a conventional primary burner (not shown) above elements 29 which is placed within chamber 28 through a selectively openable port 31 provided for this purpose. Conventional refractory material 30 is provided as a lining within chamber 12, with the refractory material being dished as at 32 to present an ashpit in the lowermost section of chamber 12. An ashpit cleanout door 34 is also provided, and both doors 18 and 34 are refractory lined as illustrated in FIG. 1.

Secondary chamber 14 includes a substantially tubular, outermost metallic shell 36 and a domed, centrally apertured top section 38 which includes upright, refractory-lined discharge stack 24. Shell 36 and top section 38 are refractory lined as illustrated at 40, with the lining presenting an internal burning chamber 42. In addition, the lining is configured to present an annular, transversely and inwardly extending shoulder surface 44 adjacent the lower-most end of shell 36 which is important for purposes to be made clear hereinafter.

Partition 16 is situated between shell 36 and the uppermost open end of primary chamber 12. The partition is generally cylindrical in configuration and includes an outermost shell 45 connected by conventional means to the lower end of shell 36 and the upper outlet end of shell 26. The cylindrical body of partition 16 is formed of refractory material and is configured to present a concavity 46 on the surface thereof facing chamber 12. A plurality of circumferentially spaced, peripheral, axially extending combustion gas-conveying apertures 48 are provided through partition 16 which serve to communicate chambers 12 and 14. As best seen in FIG. 1, the annular shoulder surface 44 is in spaced, overlying relationship to the circularly arranged apertures 48.

Secondary chamber 14 also includes a pair of obliquely disposed air inlets or tuyeres 50 which are positioned for directing positive pressure air currents at a tangent relative to the internal circular cross-section of the refractory lining 40. A common manifold 52 positioned externally of shell 36 is provided for delivering positive pressure air to the respective tuyeres 50. In practice, preheated air is fed into secondary chamber 14 through the manifold 52 and tuyeres 50 for creating a whirling pattern of airflow therewithin.

In addition, a somewhat larger secondary fuel inlet 54 is provided through the defining wall of chamber 14 for the introduction of fuel such as natural gas into the chamber. In this regard, conventional metering apparatus 56 is provided for regulating the flow of fuel into the secondary chamber 14. The whirling pattern of air and fuel created within chamber 14 through the use of tuyeres 50 and inlet 54 serves to develop high temperature conditions ideally suited for complete burning of the combustible fraction of gases and solid matter entering chamber 14.

In use, waste materials fed into primary chamber 12 are ignited through the medium of burner assembly 22. As the waste materials burn, any noncombustibles such as ashes or the like fall into the underlying ashpit, and the combustion gases (which may include particulate matter of both a combustible and noncombustible nature) pass upwardly toward partition 16. These combustion gases pass through the respective partition apertures 48 and into upper secondary combustion chamber 14. The relatively restricted openings provided by the apertures 48 serve to increase the velocity of the combustion gases. Furthermore, the concave face presented by partition 16 serves to augment the flow of gases through the apertures 48 without substantial turbulence. As can be appreciated, undue turbulence within chamber 12 may cause excessive amounts of particulate matter to rise through incinerator 10, and thus such turbulence should be minimized.

The gases and any entrained particles passing through the apertures 48 first encounter shoulder surface 44 lying directly above the apertures, which in turn causes many of the particles to drop out of suspension and fall back through the apertures 48 into the lowermost ashpit. This results because the particles are generally too heavy to be supported by the combustion gases which are necessarily slowed during contact and deflection thereof as the gases pass the baffle structure presented by shoulder surface 44. Moreover, since the combustion gases undergo a change in direction when passing from beneath the shoulder 44 into chamber 42, the result is precipitation of a relatively large percentage of the suspended particles from the gases for ultimate collection in the ashpit.

Adequate high temperature combustion conditions are maintained within secondary chamber 14 by virtue of the whirling air currents created by the tuyeres 50, and the introduction of secondary fuel through inlet 54. Specifically, the gases entering secondary chamber 14 are subjected to the whirling action of the positive pressure air currents from the tuyeres 50 in order to increase the dwell time within chamber 14. This is important for ensuring complete combustion of the burnable fraction of all particles within the secondary chamber, so that only desirable particle-free gases pass to the atmosphere through stack 24. In practice, it is contemplated that the operating temperature within secondary chamber 14 will be substantially higher than that of primary chamber 12 in order to facilitate essentially complete burning of all combustible material prior to discharge of combustion gases to the atmosphere.

Having thus described the invention, what is claimed as new and desired to be secured by Letters Patent is:

1. An incinerator, comprising:

structure defining a primary combustion chamber for receiving waste materials to be burned, and an adjacent secondary combustion chamber positioned above said primary chamber;

generally horizontally disposed partition means situated between said primary and secondary combustion chambers and configured to present a plurality of relatively small combustion gas-conveying apertures therethrough which communicate said primary and secondary chambers, have upright axes, are located in spaced relationship about the periphery of the partition means, and cooperatively present a total open area in communication with the primary chamber which is substantially less than the total surface area of the face of said partition means adjacent the primary chamber; and peripheral baffle structure located within said secondary chamber adjacent to and directly above said apertures for removal of at least a portion of any solids entrained in the gases passing through said apertures by slowing and lateral deflection of said gases as the latter pass the baffle means, and for repassage of a part of said removed solids back through said certain apertures.

2. The incinerator as set forth in claim 1 wherein said baffle structure includes annular shoulder structure spaced from said apertures.

3. The incinerator as set forth in claim 1, wherein the surface of said partition means adjacent said primary chamber is concave in configuration.

4. The incinerator as set forth in claim 1, wherein said primary and secondary chambers are vertically stacked for upward flow of combustion gases through the incinerator.

5. The incinerator as set forth in claim 1 wherein said primary chamber includes means for igniting said waste materials therewithin.

6. The incinerator as set forth in claim 1, wherein said secondary chamber is generally tubular in configuration, there being at least one opening through the defining sidewall thereof disposed for directing currents of air tangentially into the secondary chamber for creating a whirling pattern of airflow therewithin serving to assure complete combustion of said combustion gases and solids within the secondary chamber.

7. The incinerator as set forth in claim 6, wherein said defining sidewall is also configured to present a fuel inlet therethrough for the introduction of a burnable fuel directly into the secondary combustion chamber.

8. An incinerator, comprising:

structure defining a primary combustion chamber and a substantially tubular secondary combustion chamber positioned atop the primary chamber, said primary chamber including a waste material inlet and a burner for igniting said waste materials therewithin, said secondary chamber including an uppermost gas outlet and having at least one tangentially disposed air opening, and a tangentially disposed fuel inlet, in the tubular sidewall thereof;

partition means situated between said primary and secondary chambers and including a plurality of circumferentially spaced, peripheral, axially extending, combustion gas-conveying apertures therethrough communicating the primary and secondary chambers; and an annular, generally transversely extending, peripheral shoulder surface defined by the inner surface of said secondary chamber and in spaced relationship to said apertures which presents baffle means for deflecting the combustion gases through said apertures, said shoulder surface and apertures being cooperatively configured and arranged for removing at least a portion of any solids entrained within combustion gases passing from said primary chamber to the secondary chamber.

* * * * *